United States Patent [19]

Cullis

[11] 4,095,923

[45] Jun. 20, 1978

[54] PERISTALTIC PUMP WITH ACCOMMODATING ROLLERS

[75] Inventor: Herbert M. Cullis, Silver Spring, Md.

[73] Assignee: Baxter Travenol Laboratories, Inc., Deerfield, Ill.

[21] Appl. No.: 714,459

[22] Filed: Aug. 16, 1976

Related U.S. Application Data

[63] Continuation-in-part of Ser. No. 616,642, Sep. 25, 1975, abandoned.

[51] Int. Cl.[2] ..... F04B 43/08; F04B 43/12; F04B 45/06

[52] U.S. Cl. ..... 417/475; 417/477

[58] Field of Search ..... 417/477, 476, 475, 474; 92/13.2; 308/184 R

[56] References Cited

U.S. PATENT DOCUMENTS

| | | | |
|---|---|---|---|
| 460,944 | 10/1891 | Burson | 417/477 |
| 2,689,769 | 7/1954 | Ware | 308/184 R |
| 2,831,437 | 4/1958 | Cromwell et al. | 417/477 |
| 2,899,905 | 8/1959 | Becher | 417/477 |
| 2,935,028 | 5/1960 | Ferrari et al. | 417/475 |
| 3,192,863 | 7/1965 | Vadot | 417/477 |
| 3,762,836 | 10/1973 | DeVries | 417/477 |
| 3,829,251 | 8/1974 | Schwing | 417/477 |
| 3,885,894 | 5/1975 | Sikes | 417/477 |

*Primary Examiner*—Carlton R. Croyle
*Assistant Examiner*—Thomas I. Ross
*Attorney, Agent, or Firm*—H. W. Collins; Richard G. Kinney; Thomas R. Vigil

[57] ABSTRACT

The rollers of a peristaltic pump are provided with an unyielding surface, so as to insure uniform compression of the pumped tube. The rollers are mounted on their driving axles by means including yielding rubber bushings, whereby the rollers accommodate to varying diameters of pump tubing and do so without generating objectionable noise. Because the rollers yieldingly ride over the irregularities, two adjacent tubes of slightly differing diameters can simultaneously be contacted and stripped by one set of rollers.

29 Claims, 5 Drawing Figures

PERISTALTIC PUMP WITH ACCOMMODATING ROLLERS

CROSS REFERENCE TO RELATED APPLICATION

This is a continuation-in-part of U.S. application Ser. No. 616,642, filed Sept. 25, 1975, entitled "Peristaltic Pump with Forgiving Rollers", now abandoned.

BRIEF SUMMARY OF INVENTION

In order to squeeze and strip the flexible tubing of a peristaltic pump with optimum pressure a novel "forgiving" pump roller is utilized. The roller comprises a hard surface, such as steel, having a smooth low friction surface, such as a sintered polytetrafluroethylene coating or a polished and lubricated porous chromium electroplating. Such a hard surface will squeeze and strip the tubing with minimum generation of frictional heat. The roller is made to bear against the tubing with a pressure which is largely independent of minor variations in tubing diameter by mounting the hard roller on internal elastomer bushings, which in turn are mounted on bearings which support the roller and drive it along the tubing in yielding rolling contact. The elastometer bushings permit the hard roller to deflect and yieldingly ride over tubing irregularities, without creation of excessive squeezing pressure and without generation of appreciable noise. Thus, the peristaltic pump is suitable for use in a setting where quiet is desirable. More important, the peristaltic pump is especially suitable for pumping blood, because there is less hemolysis of the living blood when the squeezing pressure is correct than when it is either too small or too large.

Because of the forgiving characteristics of the pump roller, it is feasible to utilize one set of rollers to squeeze and strip a pair of side by side peristaltic pump tubings. This arrangement ensures that the two tubings pump substantially equal amounts of fluid and this arrangement is therefor suited for pumping the input and output fluids of certain processes in which the volume of fluid processed must not substantially change.

BRIEF DESCRIPTION OF VIEWS OF DRAWING

BACKGROUND OF THE INVENTION

Peristaltic pumps, in which rollers sweep tangentially along the inner race of a cylindrical housing and thereby squeeze and strip compliant tubing which lies along the inner race, are widely used to pump chemical and biological fluids. The instant invention was developed in connection with the pumping of blood, which is a living organism which must be handled gently.

An important feature of the inventive peristaltic pump is the setting of the occlusion distance between the roller of the pump and the race of the pump. The occlusion distance is critical for several reasons in biological systems. Firstly, blood is hemolyzed when the occlusion distance is either too great or too little. Secondly, when the occlusion distance is too great, resulting in a non-occluded tubing state, inefficient pumping will occur and the pump will not provide a reliable output of fluid for each revolution. If the occlusion distance is too small, in addition to harmful effects on the blood, the tubing has an extremely shortened life. The requirement to pump blood without hemolyzing it is essential to the health of the blood undergoing pumping and the patient to whom the pump may be connected or the patient to whom blood may be transfused.

The occlusion distance must be adjusted for each piece of tubing which is put into the pump. Tubing sizes will vary from lot to lot and dimension-variations will occur within a few inches of the length. Extremely close mechanical tolerances are required in order to build a peristaltic pump in which the roller will track around the race and maintain the occlusion distance within a tolerance of 0.003 inch. Because of the problems associated with either under or over occluded tubing, occlusion distance is, of course, critical. Since pumps equipped with rollers of the new design have the ability to accept tubing of various sizes without changes to the occlusion setting, thereby forgiving the operator from maladjustment problems, the rollers are called forgiving rollers.

But occlusion need not be caused by confining tubing between two rigid objects of precisely set separation; actually, occlusion can be caused by exerting enough force between two rigid objects to cause the tube to be flattened. The elastomeric inserts of the rollers of the invention permit the tubing to be flattened by the force exerted by the compression of the elastomer working over a small but variable distance. The responsibility for proper occlusion is thereby removed from uncertain dimensional setting and placed on the predictable elastomeric property of the rubber or like material.

DETAILED DESCRIPTION

Figure 1:
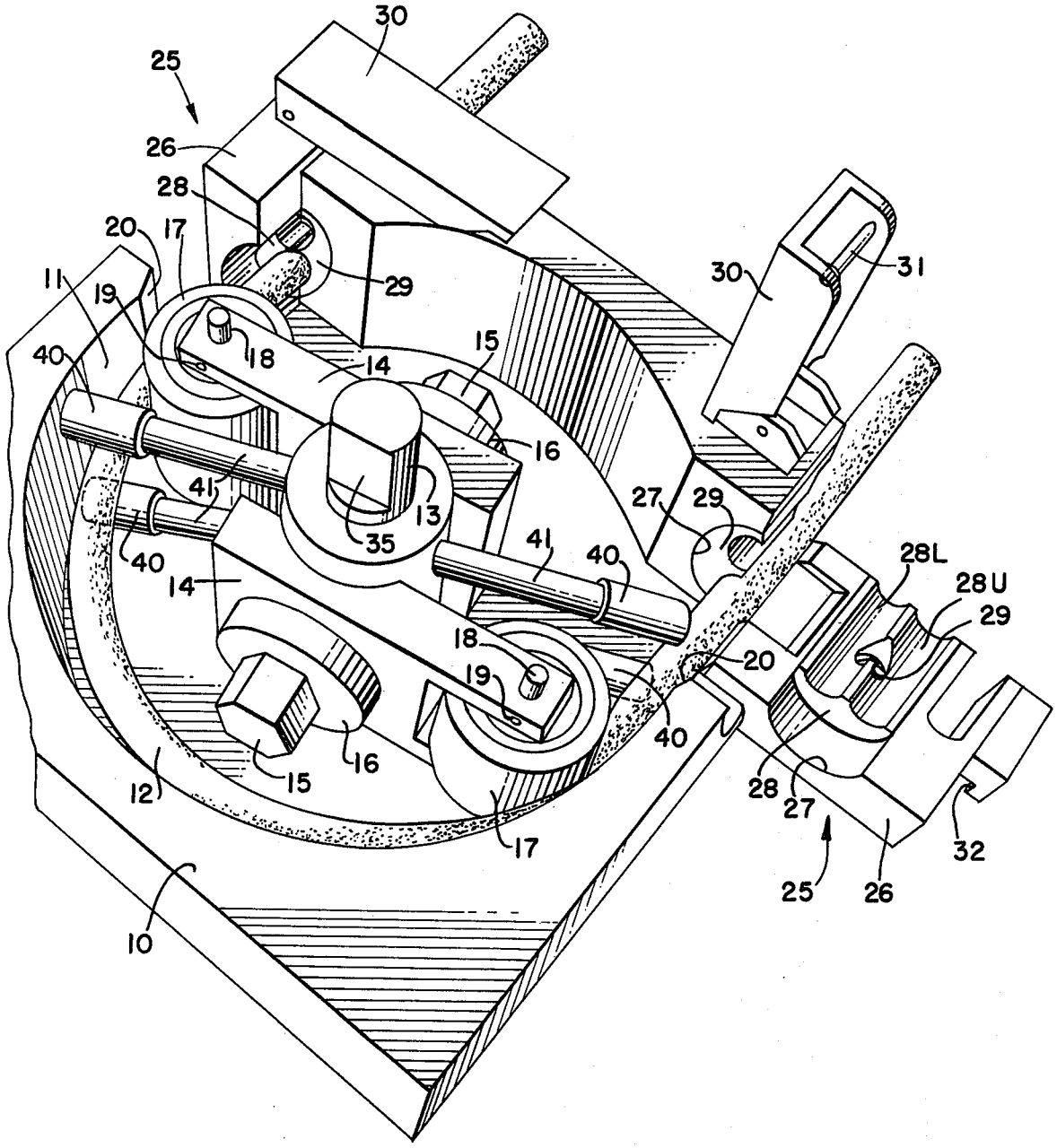
FIG. 1 is a perspective view of the peristaltic pump.
Figure 3:
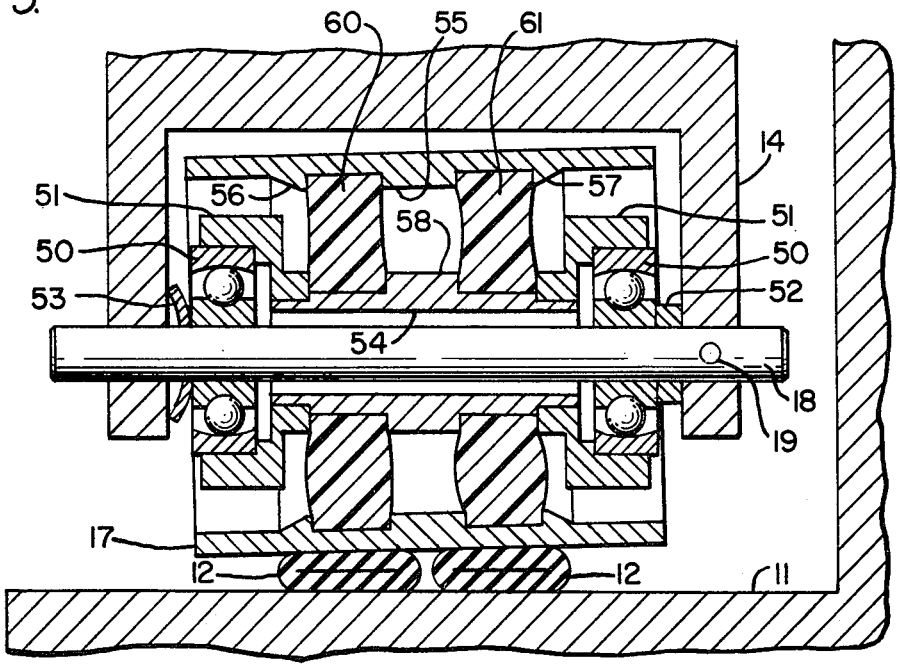
FIG. 3 is a cross sectional view of the roller, in use with two peristaltic tubings of slightly different diameter.

In the perspective view of FIG. 1, 10 is a pump casing having a race 11, along which lies, in a semicircular loop, a bight of peristaltic tubing 12 made of a suitable elastomer, such as vinyl chloride polymer or silicone rubber. A rotary shaft 13 carries two adjustable sweep arms 14, which are clamped to the rotary shaft 13 by means of cap screws 15 and washers 16. Each of the sweep arms 14 carries a roller 17, supported on the sweep arm by a respective spindle 18 which is pinned to the sweep arm by a taper pin 19 (FIG. 3).

The adjustment of the sweep arm 14 on rotary shaft 13 is such that the rollers 17 squeeze shut, or occlude, the peristaltic tubing 12. Thus, as rotary shaft 13 rotates, the rollers sweep along the semicircular bight of the peristaltic tubing 12, thereby stripping the tubing and propelling the liquid in the tubing along its length.

In order to ease the transition of the rollers between the straight run and the bight of the peristaltic tubing 12, transistor ramps 20 are provided at each end of the race 11.

In order to keep the peristaltic tubing 12 from creeping around the race in the direction of the sweep of the rollers 17, the peristaltic tubing is anchored by clamps 25. The left clamp 25 is shown closed while the right clamp 25 is shown open.

Each clamp 25 consists of a pivoted member 26 having a semicircular cut-out 27, in which sits a moveable clamping jaw 28, retained by screw 29. In the stationary part of each clamp 25, there is a similar semicircular cut-out in casing 10, in which semicircular cut-out a respective field clamping jaw 29 is similarly fastened.

The moveable clamping jaw 28 has two gripping faces, each in the form of a toothed semicylinder. The "lower" gripping face 28L cooperates with a similar gripping face in fixed clamping jaw 29 to anchor securely the peristaltic tubing 12 in the lower of two possible positions. The peristaltic tubing is shown securely gripped in the lower position of the left clamp 25, while the bore formed by the upper gripping surfaces of the left moveable and the left fixed clamping jaws 28 and 29 is shown empty, without any peristaltic tubing. Indeed, the illustrated pump can be operated with either one or two peristaltic tubings, and is especially designed for use with two tubings, but the upper one is omitted in the drawing in order to better illustrate the construction. At the right side the peristaltic tubing 12 can be seen seated in the lower gripping face of fixed clamping jaw 29, while the semicircular upper gripping face thereof, corresponding to upper gripping face 28U, is empty.

The pivoted members 26 are held in clamping position by toggle levers 30. The left toggle lever is shown in latched position, while the right one is disengaged. Each toggle lever 30 has a pin 31 which engages a lip 32 on the pivoted member 26, to draw the pivoted member up into the closed and locked position.

The rotary shaft 13 carries four guiding rollers 40, supported on sweep arms 41. Guiding rollers 40, which are mounted just ahead of the rollers 17, keep the peristaltic tubing 12 from wandering away from the appropriate portions of the rollers 17.

As depicted in FIG. 1, the semicircular bight of peristaltic tubing 12 does not lie against the race 11. This permits a better view of the race, but in use, it is advisable for the peristaltic tubing to lie close to the race, in order to prevent undue wear. This is achieved by merely pushing the excess tubing at the right into the casing and then closing the right clamp 25.

In order to load the peristaltic pump with new peristaltic tubing, it is necessary to clamp two lengths of fresh tubing in the left clamp 25 and then to rotate the rotary shaft 13. The rotary shaft 13 can conveniently be turned, for this purpose, with a hand crank having a socket which engages the upwardly protruding end of rotary shaft 13, which has a drive flat 35. When the rotary shaft 13 is rotated counterclockwise, the guiding rollers 40 will, with slight manual assistance of the operator, gather the two lengths of new peristaltic tubing, and lay them against the race 11 just ahead of the first roller 17 which makes a sweep of the semicircular race 11. The two peristaltic tubings, 12 are thusly formed into semicircular bights and their free ends can then be clamped in the right clamp 25.

Figure 2:
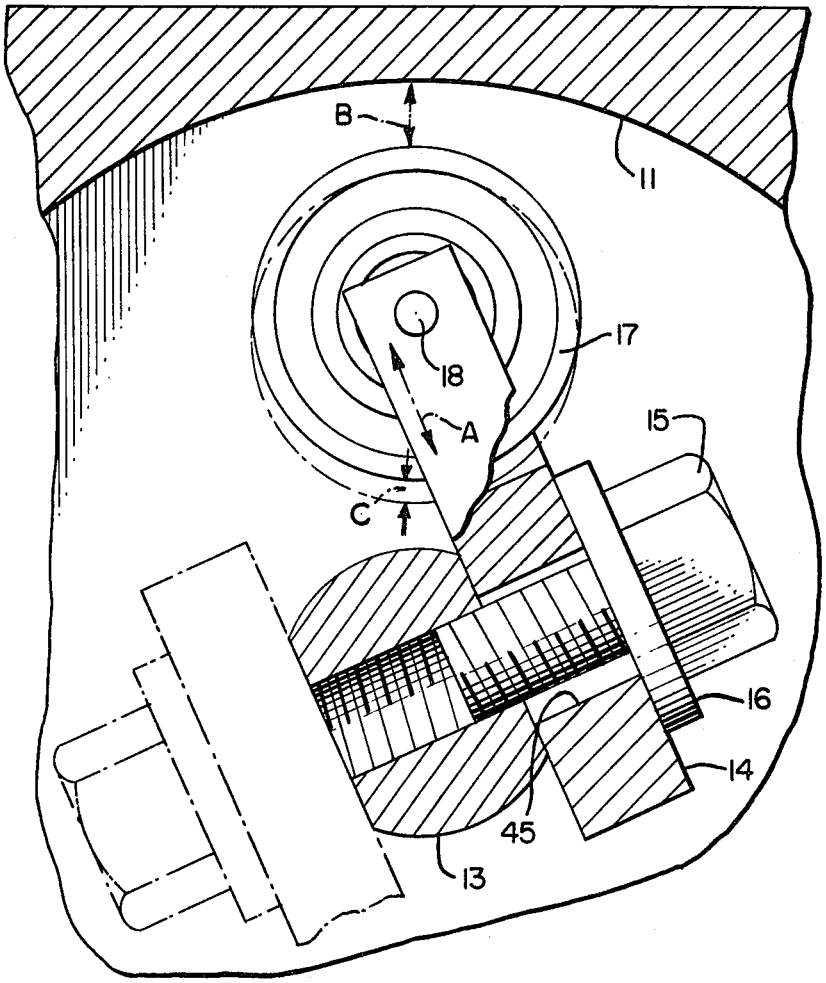
FIG. 2 is a partly exploded end-on view of the peristaltic pump, showing how the roller occlusion distance can be changed by adjustment and by deflection.

FIG. 2 illustrates how the occlusion distance, between roller 17 and race 11 is set. The adjustable sweep arm 14 is fastened to a machined seating on shaft 13 by means of cap screw 15 and washer 16. The hole 45, through which the shank of cap screw 15 is threaded, is oversize, permitting the adjustable sweep arm to be moved in its machined seating, as indicated by double-headed arrow A. The adjustment indicated by A controls the distance B, which would be the fixed occlusion distance if the roller 17 were rigidly mounted with respect to spindle 18. However, the internal construction of the hard surfaced roller 17 is such that the roller 17 can deflect, as shown by C, while the spindle 18 does not deflect. Thus, the total occlusion distance, with deflection, is the sum of B and C.

As pointed out above, the occlusion distance is fairly critical for satisfactory pumping of blood without damage to the blood, as blood must be handled gently.

Accordingly, the ability of roller 17 to deflect a distance C forgives an error in the set-up of the adjustment A, and forgives the inevitable slight variations of peristaltic tubing dimensions along the length thereof and forgives any slight eccentricity between the axis of rotary shaft 13 and the axis of the race 11.

One of the numerous possible embodiments for achieving a yielding hard surface roller 17 on an unyielding spindle 18 is illustrated in FIG. 3.

The spindle 18 is pinned into fixed relationship with sweep arm 14 by means of a taper pin 19. Two self-aligning ball bearing 50 on spindle 18 support the two outer race housings 51, which in turn support the hollow roller arbor 54 between them. The self-aligning ball bearings 50, outer race housings 51 and hollow arbor 54 are locked up into a rigid assembly because the parts fit properly and because they are subjected to an axial compression between spacer 52 and cup washer 53. The amount of this axial compression is adjusted by choice of the thickness of spacer 52, and should be such as would give the self-aligning bearings 50 a suitable preload.

Supported on hollow roller arbor 54, on either side of collar 58, are two elastomeric bushings 60 and 61, made of a material, such as rubber, of suitable hardness. The roller 17 is mounted on the outer edges of elastomeric bushings 60 and 61.

The roller 17 is shown as occluding two peristaltic tubings 12 between its outer surface and the race 11. Although the two peristaltic tubings are of the same nominal diameter, at the particular cross section shown, the left one has thinner walls and the right one has thicker walls. In FIG. 3, the effect of these different thicknesses is apparent — the roller 17 is riding over the two peristaltic tubings 12 on a sidewise slant, even though the spindle 18 is still parallel to the axis of the race 11. The roller 17 is skewed while the spindle 18 is not because the bushings 60 and 61 permit deflection of roller 17 by virtue of the lesser distortion in bushing 60 and the greater distortion in bushing 61.

In order to assemble the roller 17 of FIG. 3, the following procedure is used: elastomeric bushing 60 is forced over ramp 56 until it seats against land 55 and elastomeric bushing 61 is similarly forced over ramp 57 against land 55. Then a suitable close fitting hollow fid, having an outer diameter equal to that of collar 58, is united with hollow roller arbor 54 and the union is forced through the holes in elastomeric bushings 60 and 61 until collar 58 is seated against one elastomeric bushing, whereupon the fid is pulled out, permitting collar 58 to seat against the other elastomeric bushing.

It is preferable for the elastomeric bushings to be cemented or vulcanized to the metal parts in order to increase lifetime. If this is done, the outer race housings 51 are added to the assembly, without the self-aligning ball bearings 50, and the assembly is suitably clamped up tight in a jig before the curing processing.

Rollers constructed in accordance with this invention have undergone extensive testing and have performed well as judged by their ability to pump liquids through tubings of slightly differing dimensions without requiring mechanical adjustment of the assembly. They have also proved to be remarkably durable.

The preferred embodiment utilizes a low-friction coating on the exterior of the roller, but the use of high-friction coating on the annular race to prevent the peristaltic tubing from wandering has not proved to be necessary.

In actual operation, a peristaltic pump in accord with the teachings herein is remarkably quiet. The lack of sudden shock loads which is the result of using forgiving rollers necessarily reduces the noise level, prolongs life of the peristaltic tubing and other pump components and reduces destructive turbulence in the blood being pumped.

While the above described embodiment is preferred, the invention should not be limited to single spindled rollers or rollers wherein the outer casing revolves relative to a single fixed spindle 18.

Figure 4:
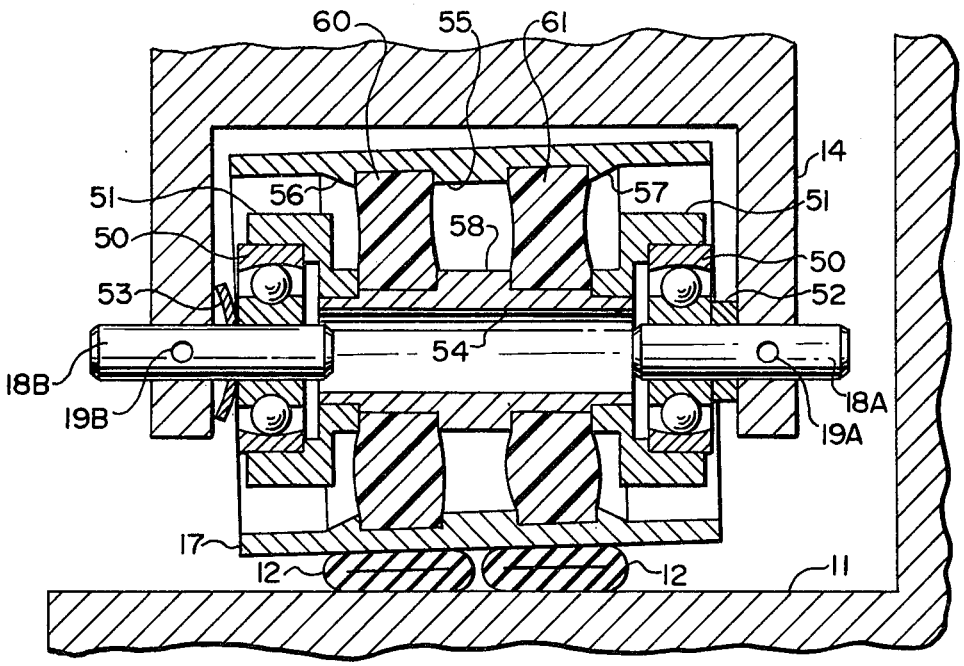
FIG. 4 is a cross sectional view, similar to FIG. 3, of an alternative construction for the roller.

For example, the construction shown in FIG. 4 may be employed wherein a pair of short spindles 18A and 18B, held by pins 19A, 19B perform the same function as the single spindle 18.

Figure 5:
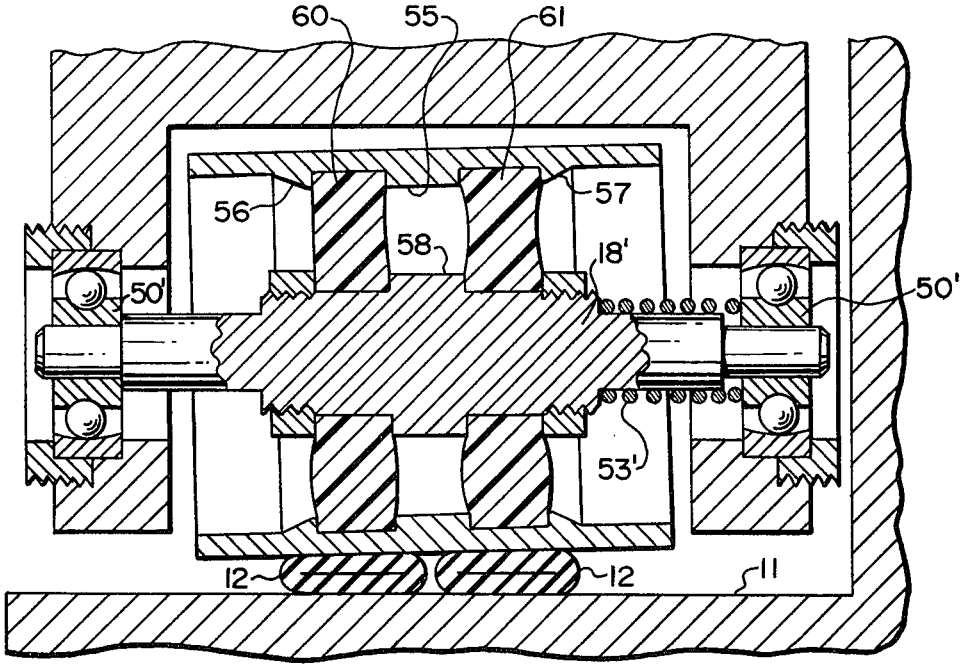
FIG. 5 is a cross sectional view, similar to FIGS. 3 and 4, showing yet another alternative construction for the roller.

Another alternative embodiment is shown in FIG. 5, wherein the spindle 18' is fixably connected to the washers 60 and 61, but journaled in bearings 50' to rotate with the roller.

It could also be noted that the elastomeric bushings 60, 61 need not necessarily be in the form of a washer, as shown, but also could be in the form of a spider having radial arms, or in other forms.

It is understood that the above description is exemplary and not limiting. More particularly, the improved rollers of this invention can be used equally well with one or two peristaltic tubes.

Further, the cylindrical race 11 can, by the exercise of ordinary skill in the art, be replaced by a conical or flat race, with which cooperate rollers of conical or cylindrical shape.

Other mechanical expedients will be obvious to those skilled in the art. For example, the spindle 18, which spans both ball bearings 50, could be replaced by two stub shafts, each individual to one bearing (in which case the arbor 54 need not be hollow). In the embodiment disclosed, the outer races of ball bearings 50 rotate, while the inner races are fixed to the sweep arm 14. However, the outer races of ball bearings 50 could be fixed to the sweep arm 14 and the inner races could rotate with and support the roller 17.

I claim:

1. A peristaltic pump which is capable of pumping two tubings of different diameter and which has an arcuate race;

one or more peristaltic pumping tubings disposed along the length of the race and having inlet and discharge portions;

a rotary shaft mounted to rotate about an axis coincident with the axis of said race;

a sweep arm;

means to adjustably mount said sweep arm on said rotary shaft;

a spindle fixedly mounted on said sweep arm in spaced relationship with said race, the constant distance between said spindle and said race being determined by the adjustment of the mounting of said sweep arm;

bearing means rotatable on said spindle;

a sleeve rotating about said spindle and supported by said bearing means;

annular elastomeric means supported by said sleeve; and a rigid surface roller supported by said elastomeric means concentrically about said spindle; said elastomeric means permitting skewing of the roller axis;

said rigid roller being of such size as to squeeze and substantially occlude said peristaltic tubing between the surface of said roller and the race at a given adjustment of said mounting of said sweep arm;

whereby, when said rotary shaft is rotated, the said rigid surface roller sweeps along the length of the one or more peristaltic pumping tubings in said race, thereby stripping said peristaltic pumping tubings and pumping fluid contained therein and forcing said fluid from said inlet portion to said discharge portion, and whereby, when two peristaltic pumping tubings of different diameters are utilized, the rigid surface roller can be variably deflected as a result of deflection of the elastomeric support therefor by variable force applied to its rigid surface by two peristaltic pumping tubings, despite the said constant distance between said spindle and said race, determined by said adjustment of the mounting of said sweep arm.

2. The peristaltic pump of claim 1 in which the outer face of said roller is coated with a smooth coating of polytetrafluoroethylene.

3. The peristaltic pump of claim 1 in which the said arcuate race is a cylinder of revolution.

4. The peristaltic pump of claim 1 in combination with guiding means, mounted on said rotary shaft and rotating therewith for guiding and confining the said one or more peristaltic pumping tubings to the portion of said race whereat it will be in operative relationship with said rigid surface roller.

5. The peristaltic pump of claim 4 in which said guiding means comprises guard arms which sweep along the race at the outer bounds of said portion of said race.

6. The peristaltic pump of claim 4 in which the said guiding means includes guiding rollers mounted on said guiding means for contacting said one or more peristaltic pumping tubings in its extreme position, at the edge of said portion of said race.

7. The peristaltic pump of claim 4 in which the said guiding means is located immediately ahead of said rigid surface roller, in the direction of its sweep, so as to contact said one or more peristaltic pumping tubings, when said tubing is in extreme position at the edge of said portion of said race;

whereby said guide means guides and confines said peristaltic pumping tubing immediately before it is squeezed and stripped by the said rigid surface roller.

8. For use in a peristaltic pump which is capable of pumping two tubings of different diameter and which has a race and has a spindle mounted on means to sweep along said race at a fixed distance therefrom;

a roller having rotational symmetry mounted concentrically on said spindle;

one or more peristaltic pumping tubings disposed along the length of the race and having inlet and discharge portions;

said roller being of such size as to suitably occlude said one or more peristaltic pumping tubings between a surface of the roller and the race;

the said surface of the roller being rigid and substantially unyielding to applied force;

bearing means mounted for free rotation about said spindle;

said roller being mounted on said bearing means for free rotation about the axis of said spindle;

a sleeve rotatable about said spindle and supported by said bearing means; and annular elastomeric means between said sleeve and said roller for spacing the said surface of said roller from and for supporting said surface on said sleeve said elastomeric means permitting skewing of the roller axis;

whereby said rigid surface, as a whole, when two peristaltic pumping tubings of different diameters are utilized, can be deflected by pressure applied to any locale of said rigid surface by two peristaltic pumping tubings through deflection of said elastomeric means without appreciable local distortion of said rigid surface of said roller.

9. The roller of claim 8 having a layer of slick, low-friction material on said surface.

10. The roller of claim 9 in which the slick, low-friction material is polytetrafluoroethylene.

11. A peristaltic pump which is capable of pumping two tubings of different diameter and which has a cylindrical race, a pump roller, and one or more peristaltic pump tubings having inlet and discharge portions occluded between said cylindrical race and said pump roller, forcing fluid from said inlet portion to said discharge portion;

a drive shaft rotating on the axis of said cylindrical race;

a sweep arm rotating synchronously about said axis and driven by said shaft;

bearings mounted on said sweep arm;

rotatable sleeve means mounted on said bearings;

annular elastomeric bushing means mounted on said sleeve means to spin freely in said sweep arm, and thereby defining a spin axis;

said spin axis being parallel to said axis of said cylindrical race; and a hard-surface, rigid shell mounted on and supported by said bushing means and having an outer face which is concentric with the said spin axis; said elastomeric bushing means permitting skewing of said shell axis;

whereby pressure applied to any locale of the said shell by said one or more peristaltic pump tubings does not locally distort said shell, but does distort the said elastomeric bushing and deflects the said shell as a whole without deflection of said synchronously rotating sweep arm, and whereby, when two peristaltic pumping tubings of different diameters are utilized, the rigid shell can be variably deflected as a result of the deflection of the elastomeric bushing means by variable force applied to the rigid shell by two peristaltic pumping tubings.

12. The peristaltic pump of claim 11 having a layer of polytetrafluoroethylene on the surface of said hard surface rigid shell.

13. A peristaltic pump which is capable of pumping two tubings of different diameter and which comprises:

a race having a central axis and an arcuate pumping face which is a figure of revolution about said central axis;

one or more peristaltic pumping tubings disposed along the length of the arcuate pumping face of the race;

a rotary shaft mounted to rotate about an axis coincident with the central axis of said race;

a sweep arm mounted on said rotary shaft;

bearing means mounted on said sweep arm in spaced relationship with the pumping face of said race;

said bearing means defining a planetary axis of rotation;

means to adjust the position of said bearing means with respect to said rotary shaft and thereby vary the spacing between said bearing means and the arcuate pumping face of said race;

an annular elastomeric roller support means, supported by said bearing means for rotation about said planetary axis; and a rigid shell mounted on said elastomeric roller support means for rotation therewith about said planetary axis and having an exterior surface which is rotationally symmetric about said planetary axis; said elastomeric roller support means permitting skewing of the shell axis;

said rigid shell being of such size as to squeeze and substantially occlude said one or more peristaltic tubings between the exterior surface of said rigid shell and the race at a given adjustment of said position of said bearing means;

whereby, when said rotary shaft is rotated, the said rigid shell sweeps along the length of the one or more peristaltic pumping tubings in said race, thereby stripping said one or more peristaltic pumping tubings and pumping fluid contained therein, and whereby the rigid shell can be variably deflected by variable force applied to its rigid surface by two peristaltic pumping tubings of different diameter, despite fixed spatial relationship between said bearing means and said rotary shaft.

14. For use in a peristaltic pump which is capable of pumping two tubings of different diameter and which has an arcuate race symmetric about a central axis, one or more peristaltic pumping tubings disposed along the length of said arcuate race, and a rotary sweep arm rotating about said central axis and having bearing means for defining a planetary axis for mounting a peristaltic pumping roller of such size as to suitably occlude said one or more peristaltic pumping tubings between the surface of the said roller and the said arcuate race as said arm rotates about said central axis, to thereby pump fluid in said one or more peristaltic tubings;

the said roller having a surface which is rigid and substantially unyielding to locally applied force;

said roller being mounted on concentric bearing means for free rotation about said planetary axis; and annular elastomeric means between said roller and said bearing means for spacing the rigid surface of said roller from and for supporting said rigid surface on said bearing means said elastomeric means permitting skewing of the roller axis;

whereby said rigid surface, as a whole, can be variably deflected by pressure applied to any locale of said rigid surface by two peristaltic pumping tubings of different diameters through deflection of said elastomeric means, without appreciable local distortion of said rigid surface of said roller.

15. The peristaltic pump of claim 1, wherein said annular elastomeric means comprise two spaced-apart annular rings of elastomeric material.

16. The peristaltic pump of claim 15, wherein each of said rings is spaced inwardly of one axial end of said roller.

17. The peristaltic pump of claim 15, wherein each of said rings has a radial thickness greater than its axial thickness.

18. The peristaltic pump of claim 8, wherein said annular elastomeric bushing means comprise two spaced-apart annular rings of elastomeric material.

19. The peristaltic pump of claim 18, wherein each of said ring is spaced inwardly of one axial end of said sleeve.

20. The peristaltic pump of claim 18, wherein each of said rings has a radial thickness greater than its axial thickness.

21. The peristaltic pump of claim 11, wherein said annular elastomeric means comprise two spaced-apart annular rings of elastomeric material.

22. The peristaltic pump of claim 21, wherein each of said rings is spaced inwardly of one axial end of said shell.

23. The peristaltic pump of claim 21, wherein each of said rings has a radial thickness greater than its axial thickness.

24. The peristaltic pump of claim 13, wherein said annular elastomeric means comprise two spaced-apart annular rings of elastomeric material.

25. The peristaltic pump of claim 24, wherein each of said rings is spaced inwardly of one axial end of said shell.

26. The peristaltic pump of claim 24, wherein each of said rings has a radial thickness greater than its axial thickness.

27. The peristaltic pump of claim 14, wherein said annular elastomeric support means comprise two spaced-apart annular rings of elastomeric material.

28. The peristaltic pump of claim 27, wherein each of said rings is spaced inwardly of one axial end of said roller.

29. The peristaltic pump of claim 27, whrein each of said rings has a radial thickness greater than its axial thickness.

* * * * *